United States Patent [19]

Morrow

[11] 4,026,307

[45] May 31, 1977

[54] AFRO COMB

[76] Inventor: Willie L. Morrow, 4167 Market St., San Diego, Calif. 92102

[22] Filed: Mar. 26, 1976

[21] Appl. No.: 670,730

[52] U.S. Cl. ..... 132/11 R; 132/161

[51] Int. Cl.[2] ..... A45D 24/00

[58] Field of Search ..... 132/11, 48, 161, 137, 132/160, 125, 137, 141–142, 138

[56] References Cited

UNITED STATES PATENTS

| | | | |
|---|---|---|---|
| 2,348,339 | 5/1944 | Golden | 132/161 |
| 2,844,154 | 7/1958 | Solomon | 132/48 R |
| 3,792,707 | 2/1974 | Tupper | 132/11 R |

*Primary Examiner*—G.E. McNeill

*Attorney, Agent, or Firm*—Ralph S. Branscomb

[57] ABSTRACT

The invention is a comb adapted for curly and particularly kinky hair and utilizes teeth which are provided with notches or relieved portions along the sides thereof, such that adjacent teeth define hair-receiving channels which are other than parallel-sided, these channels being expanded at intervals along their length to define either generally serpentine shapes or having spaced substantially circular expanded areas along their length to facilitate the passage of curly hair therethrough, and an expanded area of the channels at the base of the teeth permits the accumulation therein of hair as it is combed, without resulting in wedging and binding, which ordinarily occurs at the juncture of the teeth with the spine, there also being a specialized arcuate bay in the comb handle having an expanded end to permit the simplified parting of the hair without the wedging of the hair as would occur should a normal comb be used to make the part.

3 Claims, 7 Drawing Figures

AFRO COMB

BACKGROUND OF THE INVENTION

Conventional combs tend to tug and pull out the hair as they are passed through it, both because the hair becomes bunched between the teeth, and because it becomes wedged in the ordinarily tapered juncture of the teeth with the spine. This effect is aggravated when the comb is used in kinky hair and has resulted in the development of the so-called "Afro" comb which is in popular current use among Blacks. However, a typical Afro comb is somewhat awkward in that the teeth are extraordinarily long and in some of these combs there is still a tendency for the hair to bunch and bind.

SUMMARY OF THE INVENTION

The comb of the instant invention combines the advantages of the long-toothed Afro comb with the compactness of the conventional comb, and provides the additional advantage of having an easily utilized part-effecting handle.

The teeth of the instant comb, unlike those of either conventional combs or Afro combs, are not parallel-sided but are provided with strategically placed notches or cut-aways so that the channels defined therebetween are periodically expanded, in one embodiment forming a somewhat curvaceous configuration, and in another periodic expanded circular portions are created, in either case the irregularities incorporated in the sides of the teeth allowing for the expansion, and thus freeing, of hair which has become bunched in the outer portions of the hair receiving channels. The channels become enlarged at the point where the teeth join the comb spine so that this area, which ordinarily is conducive to the wedging of hair caused by the V-shaped juncture of the teeth with the spine, permits the passage of hair in bunches therethrough so that hair is not pulled. The comb is provided with a handle with a curved slot which forms a point on one side, the innermost end of the slot being widened, again to permit the passage therethrough of bunched hair.

DETAILED DESCRIPTION OF THE PREFERRED EMBODIMENTS

Figure 1:
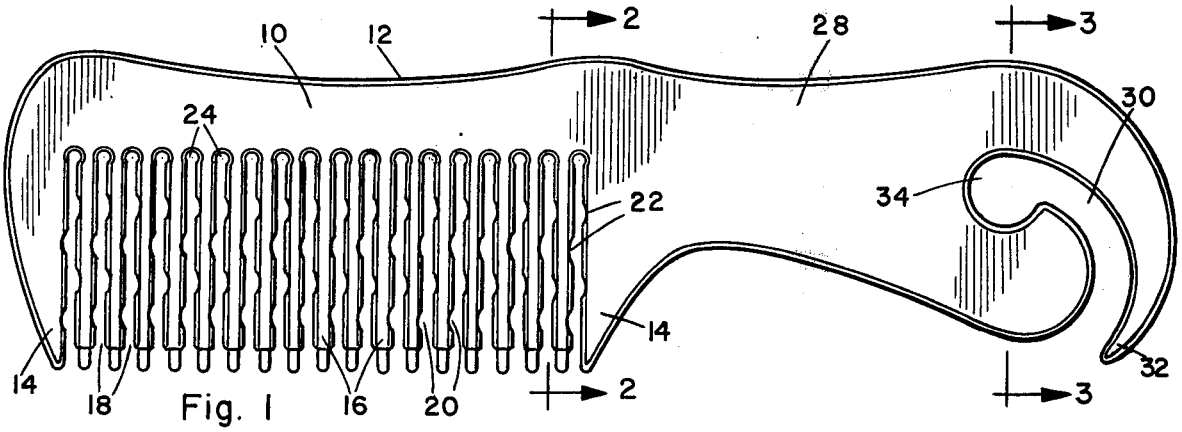
FIG. 1 is a side elevation view of the comb.
Figure 2:
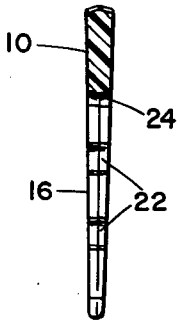
FIG. 2 is a sectional view taken on line 2—2 of FIG. 1.
Figure 3:
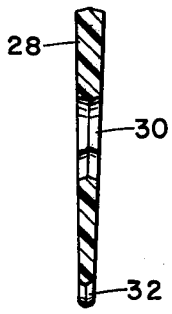
FIG. 3 is a sectional view taken on line 3—3 of FIG. 1.

The comb is shown in full in FIG. 1 and has a spine 10 the rear surface of which is curved at 12 to conform generally to the shape of the head so that it may be used to smooth the hair. The spine joins the large end teeth 14 and connects with the central teeth 16, the entire structure preferably being molded of plastic or the like.

Each pair of adjacent teeth defines a channel 18 therebetween which of course receives hair during the combing operation, and each of these channels, in contrast to the ordinary configuration thereof, is formed into widened or expanded areas 20 by means of strategically placed notches or relieved portions 22 in the comb teeth. Because of these notches, the tendency of the hair to bunch as it enters the teeth of the comb is greatly reduced, and because of a final expanded area 24 at the base of the notch, as the comb is pulled through the hair, the hair will not wedge between the teeth.

Figure 4:
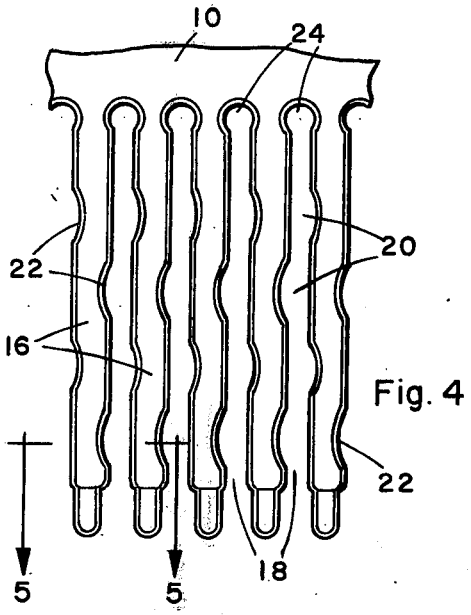
FIG. 4 is an enlarged detail of the teeth.

It can be seen from an examination of FIGS. 1 and 4 that the notches 22 in the sides of the teeth are staggered for each individual channel such that a somewhat serpentine configuration is achieved, which could be exaggerated by rounding the edges of the notches, and this arrangement has the additional effect of creating a channel whose effective length is longer than the linear length of the teeth that are used.

Figure 5:
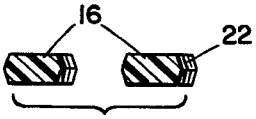
FIG. 5 is a further enlarged sectional view taken on line 5—5 of FIG. 4.
Figure 6:
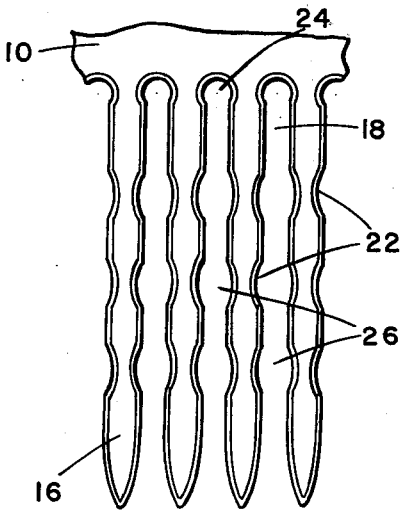
FIG. 6 illustrates an alternative tooth configuration.
Figure 7:
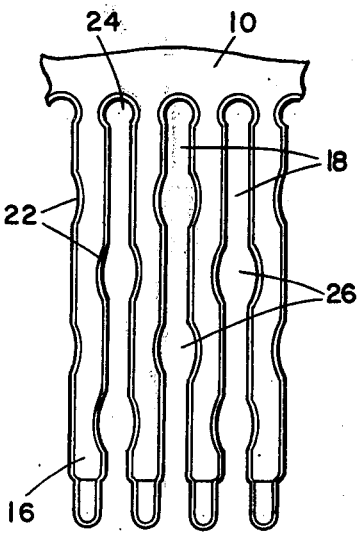
FIG. 7 illustrates a further tooth configuration.

Another notch configuration is illustrated in FIG. 6 wherein the notches of adjacent teeth are juxtaposed to form an oval or somewhat circular area 26 for the abovementioned purpose, and the embodiment illustrated in FIG. 7 is similar in effect to that illustrated in FIG. 6 except that the ovals 26 are staggered from one channel to the next. It can also be seen, particularly in FIGS. 2–5, that the surfaces of the channels are not flat but slightly tapered, this being particularly evident in FIG. 5. Alternatively, these edges could of course be smoothly contoured.

Referring again to FIG. 1, the spine 10 of the comb smoothly continues to define a flat planar handle 28 in which is formed an arcuate slot or bay 30 which in turn forms a curved pointed member 32, the interior end of the slot being expanded at 34 so that when the pointed end 32 is pulled through the hair to form a part, hair does not bunch and become wedged in the slot but rather passes freely through the expanded portion 34.

Thus the comb in its several embodiments is ideal as an Afro comb, having the advantages of permitting the free combing of the hair without wedging and jambing, as well as the advantage of the short teeth utilized in a conventional comb, the addition of the part-forming slot also being entirely original.

I claim:

1. A comb comprising:

a. a spine;

b. a plurality of straight parallel teeth defining a plane with said spine;

c. adjacent ones of said teeth defining channels therebetween and the opposed edges of adjacent teeth being straight and parallel and each of said edges having at least one cut-away portion therein to define expanded areas in said channels to permit the periodic expansion of hair clusters passed through said channels toward said spine;

d. each of said channels being expanded at the junctions of said channel - defining teeth with said spine, whereby upon combing the hair, bunching and wedging of the hair in the channels at the spine is prevented.

2. Structure according to claim 1 wherein each adjacent pair of said channel-defining teeth are provided with a plurality of aligned opposed arcuate relieved portions whereby each of said channels is provided with a plurality of discrete spaced generally oval portions expanded into both sides of the channel.

3. Structure according to claim 1 and including a handle attached to said spine, said handle being essentially planar and defining an arcuate slot with an expanded interior end to facilitate the parting of the hair with said handle.

* * * * *